US011499740B2

(12) United States Patent
Hashimoto

(10) Patent No.: US 11,499,740 B2
(45) Date of Patent: Nov. 15, 2022

(54) AIR-CONDITIONING MANAGEMENT APPARATUS AND AIR-CONDITIONING SYSTEM

(71) Applicant: Mitsubishi Electric Corporation, Tokyo (JP)

(72) Inventor: Yosuke Hashimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 113 days.

(21) Appl. No.: 17/051,277

(22) PCT Filed: Jun. 26, 2018

(86) PCT No.: PCT/JP2018/024161
§ 371 (c)(1),
(2) Date: Oct. 28, 2020

(87) PCT Pub. No.: WO2020/003373
PCT Pub. Date: Jan. 2, 2020

(65) Prior Publication Data

US 2021/0095884 A1 Apr. 1, 2021

(51) Int. Cl.
*F24F 11/84* (2018.01)
*F24F 11/48* (2018.01)
(Continued)

(52) U.S. Cl.
CPC ..... *F24F 11/84* (2018.01); *F24F 11/48* (2018.01); *F24F 11/61* (2018.01);
(Continued)

(58) Field of Classification Search
CPC ..... F24F 11/84; F24F 11/48; F24F 2110/10; F24F 11/64
See application file for complete search history.

(56) References Cited

U.S. PATENT DOCUMENTS 10,060,643 B2 * 8/2018 Takeda ..... F24D 19/1084
2012/0006050 A1 1/2012 Takayama et al.
(Continued)

FOREIGN PATENT DOCUMENTS

JP 2004-085141 A 3/2004
JP 5460701 B2 4/2014
(Continued)

OTHER PUBLICATIONS

International Search Report of the International Searching Authority dated Sep. 25, 2018 for the corresponding international application No. PCT/JP2018/024161 (and English translation).

*Primary Examiner* — Lionel Nouketcha
(74) *Attorney, Agent, or Firm* — Posz Law Group, PLC

(57) ABSTRACT

An air-conditioning management apparatus includes: a storage unit that stores a schedule including a set time and a set temperature; a communication processing unit that communicates with the air-conditioning apparatus and receives operation status information including a heat medium temperature; and a controller that performs a schedule control to control the air-conditioning apparatus according to the schedule. The schedule control includes an optimal start-up control to control the air-conditioning apparatus such that an indoor space temperature reaches the set temperature at the set time, by starting an operation of the air-conditioning apparatus before the set time. The controller performs a preheating control or a precooling control to control the heat source unit such that before the optimal start-up control is started, the heat medium temperature included in the operation status information obtained from the air-conditioning apparatus falls within a target range including a previously set target heat medium temperature.

9 Claims, 5 Drawing Sheets

(51) Int. Cl.
*F24F 11/61* (2018.01)
*F24F 110/10* (2018.01)

(52) U.S. Cl.
CPC ..... *F24F 2110/10* (2018.01); *F24F 2203/104* (2013.01); *F24F 2203/1076* (2013.01)

(56) References Cited

U.S. PATENT DOCUMENTS

| | | | |
|---|---|---|---|
| 2012/0031605 | A1 | 2/2012 | Takayama et al. |
| 2015/0300676 | A1 | 10/2015 | Motomura et al. |
| 2016/0003490 | A1 | 1/2016 | Motomura et al. |

FOREIGN PATENT DOCUMENTS

| | | | |
|---|---|---|---|
| WO | 2010/113296 | A1 | 10/2010 |
| WO | 2014/083681 | A1 | 6/2014 |
| WO | 2014/128961 | A1 | 8/2014 |

* cited by examiner

AIR-CONDITIONING MANAGEMENT APPARATUS AND AIR-CONDITIONING SYSTEM

CROSS REFERENCE TO RELATED APPLICATION

This application is a U.S. national stage application of PCT/JP2018/024161 filed on Jun. 26, 2018, the contents of which are incorporated herein by reference.

TECHNICAL FIELD

The present disclosure relates to an air-conditioning management apparatus that manages an operation of an air-conditioning apparatus, and an air-conditioning system.

BACKGROUND ART

Recently, concerns have been rising with respect to the effect of refrigerant for use in air-conditioning apparatuses on the environment and human bodies, and an air-conditioning apparatus has been proposed that air-conditions an indoor space by applying a heat medium, such as water, for the indoor space, without directly applying refrigerant for the indoor space (see, for example, Patent Literature 1). In Patent Literature 1, at a refrigerant-heat-medium heat exchanger, heat exchange is performed between refrigerant that flows in a refrigerant circuit and a heat medium that flows in a heat medium circuit, to thereby cool or heat the heat medium until the temperature of the heat medium reaches a desired temperature, and heat exchange is performed between the heat medium and air in the indoor space, to thereby cool or heat the indoor space.

Furthermore, in an existing air-conditioning system, time and a temperature are set in advance, to thereby perform a schedule control to cause an air-conditioning apparatus to be automatically operated. Also, in an existing technique, in a schedule control, an optimal start-up control is performed to cause an air-conditioning apparatus to be started before a previously set time, whereby the temperature of an indoor space reaches a set temperature before the set time.

CITATION LIST

Patent Literature

Patent Literature 1: International Publication No. WO 2014/128961

SUMMARY OF INVENTION

Technical Problem

In the air-conditioning apparatus disclosed in Patent Literature 1, in the case where the optimal start-up control is performed, it is important to manage the temperature of the heat medium that is applied for into the indoor space. To be more specific, the temperature of the heat medium greatly changes, for example, at a sweltering night in summer or because of a sudden temperature drop in winter. Therefore, unless the optimal start-up control is performed in consideration of the temperature of the heat medium, in some cases, it is not possible to cause the indoor space temperature to reach the set temperature before the set time.

The present disclosure is applied in view of the above, and relates to an air-conditioning management apparatus and an air-conditioning system that can prevent the temperature of the heat medium at the start time of the optimal start-up control from varying from that at one start-up time of the optimal start-up time to that at another start-up time of the optimal start-up control.

Liquid to Problem

An air-conditioning management apparatus according to an embodiment of the present disclosure controls an air-conditioning apparatus that includes: a heat source unit; one or more indoor units; and a refrigerant-heat-medium heat exchanger configured to cause heat exchange to be performed between refrigerant that flows in the heat source unit and a heat medium that flows in the one or more indoor units to heat or cool the heat medium and heat or cool an indoor space. The air-conditioning management includes: a storage unit that stores a schedule including a set time and a set temperature; a communication processing unit that communicates with the air-conditioning apparatus and receives operation status information including a heat medium temperature that is a temperature of the heat medium; and a controller that performs a schedule control to control the air-conditioning apparatus according to the schedule. The schedule control includes an optimal start-up control to control the air-conditioning apparatus such that an indoor space temperature that is a temperature of the indoor space reaches the set temperature at the set time, by starting an operation of the air-conditioning apparatus before the set time. The controller performs a preheating control or a precooling control to control the heat source unit such that before the optimal start-up control is started, the heat medium temperature included in the operation status information obtained from the air-conditioning apparatus falls within a target range including a previously set target heat medium temperature.

Advantageous Effects of Invention

According to one embodiment of the present disclosure, before the optimal start-up control is started, the preheating control or the precooling control to control the heat source unit is performed such that the heat medium temperature falls within the target range including the previously set target heat medium temperature. Thus, it is possible to prevent the temperature of the heat medium at the start time of the optimal start-up control from varying from that at one start-up time of the optimal start-up time to that at another start-up time of the optimal start-up control.

DESCRIPTION OF EMBODIMENTS

Embodiment 1

Figure 1:
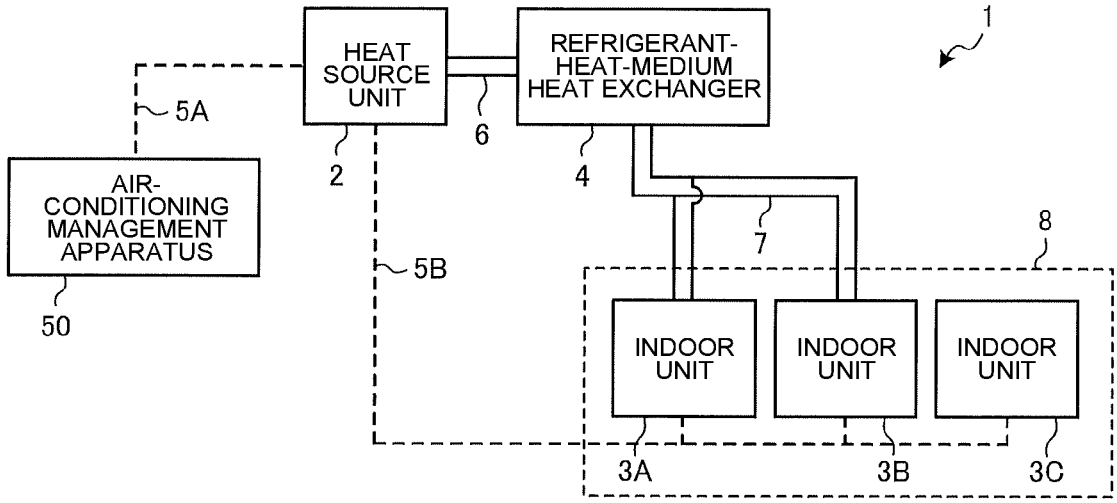
FIG. 1 is a diagram illustrating an example of a configuration of an air-conditioning system including an air-conditioning management apparatus according to Embodiment 1 of the present disclosure.

FIG. 1 is a diagram illustrating an example of the configuration of an air-conditioning system including an air-conditioning management apparatus according to Embodiment 1 of the present disclosure. In figures from FIG. 1 onward, components that are the same as or equivalent to those in a previous figure are denoted by the same reference signs. The same is true of the entire text of the specification. Furthermore, the configurations of the components as described in the entire text of the specification are merely examples, that is, the configurations of the components are not limited to those as descried in the entire text of the specification.

The air-conditioning system includes an air-conditioning apparatus 1 that air-conditions an indoor space 8 by performing a cooling operation or a heating operation, and an air-conditioning management apparatus 50 that manages air-conditioning of the air-conditioning apparatus 1. The air-conditioning apparatus 1 includes a heat source unit 2, an indoor unit 3A, an indoor unit 3B, an indoor unit 3C, and a refrigerant-heat-medium heat exchanger 4. The indoor unit 3A, the indoor unit 3B, and the indoor unit 3C operate as load-side units (may be hereinafter referred to as indoor units 3). The indoor units 3 are installed in the same indoor space 8. The air-conditioning management apparatus 50 is connected to the heat source unit 2 by a communication line 5A. The heat source unit 2 is connected to each of the indoor units 3 by a communication line 5B.

The heat source unit 2 is connected to the refrigerant-heat-medium heat exchanger 4 by a refrigerant pipe 6. In addition, each of the indoor units 3 is connected to the refrigerant-heat-medium heat exchanger 4 by a heat medium pipe 7. It will be described with reference to FIG. 2 how the heat source unit 2, each of the indoor units 3, and the refrigerant-heat-medium heat exchanger 4 are connected by the refrigerant pipe 6 and the heat medium pipe 7. It should be noted that although in the example illustrated in FIG. 1, the number of the indoor units 3 connected in the above manner is three, the number of the connected indoor units 3 is arbitrarily determined.

Figure 2:
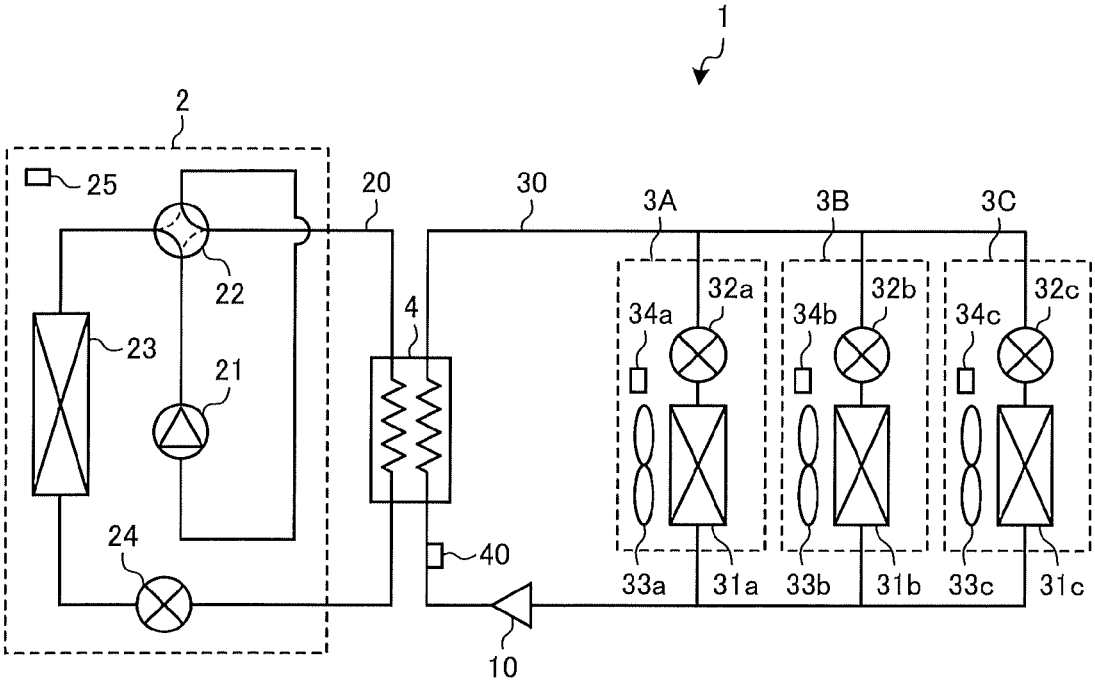
FIG. 2 is a circuit configuration diagram of an air-conditioning apparatus of the air-conditioning system according to Embodiment 1 of the present disclosure.

FIG. 2 is a circuit configuration diagram of the air-conditioning apparatus of the air-conditioning system according to Embodiment 1 of the present disclosure.

The heat source unit 2 includes a compressor 21, a four-way valve 22, a heat-source-side heat exchanger 23, and an expansion valve 24. Each of the indoor unit 3 is a fan coil unit (FCU). The indoor unit 3A, the indoor unit 3B, and the indoor unit 3C have the same configuration. Therefore, the configuration of each of the indoor units 3 will be described by referring to the configuration of one of the indoor units 3. In the following, the configuration of the indoor unit 3A is descried. The indoor unit 3A includes an indoor heat exchanger 31*a*, a flow control valve 32*a* that adjusts the flow rate of the heat medium that flows into the indoor unit 3A itself, and a fan 33*a*. The indoor unit 3B and the indoor unit 3C include the same components as the indoor unit 3A, which will be denoted by reference signs including the suffixes "b" and "c". That is, the components of the indoor unit 3B are denoted by reference signs including the suffix "b", and the components of the indoor unit 3B are denoted by reference signs including the suffix "c". It should be noted that in the following description, in the case where the indoor heat exchanger, the flow control valve, and the fan of each of the indoor units 3 does not need to be distinguished from those of the other indoor units 3, they are referred to as indoor heat exchanger 31, flow control valve 31 and fan 33 without the suffixes.

Then, the air-conditioning system includes a refrigerant circuit 20 and a heat medium circuit 30. The refrigerant circuit 20 is a circuit in which the refrigerant circulates in the compressor 21, the four-way valve 22, the heat-source-side heat exchanger 23, the expansion valve 24, and the refrigerant-heat-medium heat exchanger 4. The heat medium circuit 30 is a circuit in which the heat medium circulates in the refrigerant-heat-medium heat exchanger 4, the flow control valve 32, the indoor heat exchanger 31, and a pump 10. The flow rate of the heat medium that circulates in the entire the heat medium circuit 30 is controlled by the pump 10. As the heat medium, for example, water, an antifreeze liquid, or a mixed liquid of water and an antifreeze liquid is used.

The compressor 21 sucks refrigerant, and compress the refrigerant into a high temperature, high pressure refrigerant. The compressor 21 is a positive displacement compressor that can be changed in operating frequency.

The four-way valve 22 switches a circulation direction of the refrigerant discharged from the compressor 21 between the circulation direction of the refrigerant in the cooling operation and that in the heating operation. In response to this switching of the four-way valve 22, during the cooling operation, the heat-source-side heat exchanger 23 operates as a condenser, and the indoor heat exchanger 31 operates as an evaporator, and during the heating operation, an outdoor heat exchanger 14 operates as an evaporator, and the indoor heat exchanger 31 operates as a condenser. It should be noted that that although it is described above that the operation to be performed is switched to either the cooling operation or the heating operation by the switching of the four-way valve 22, it suffices that the air-conditioning system according to the embodiment of the present disclosure can perform at least one of the above operations. Therefore, the four-way valve 22 is not indispensable, and can be omitted.

The refrigerant-heat-medium heat exchanger 4 causes heat exchange to be performed between the refrigerant that circulates in the refrigerant circuit 20 and the heat medium that circulates in the heat medium circuit 30.

The expansion valve 24 reduces the pressure of the refrigerant to expand the refrigerant. The expansion valve 24 adjusts the flow rate of the refrigerant that flows in the refrigerant circuit 20.

The indoor heat exchanger 31 causes heat exchange to be performed between the heat medium that circulates in the heat medium circuit 30 and indoor air, to thereby heat or cool the indoor space.

The flow control valve 32 is adjusted in opening degree to adjust the flow rate of the heat medium that flows into the indoor heat exchanger 31, thereby adjusting the temperature in the indoor unit 3.

The fan 33 is a fan that sends air, and can adjust the flow rate of air to be sent.

Next, sensors provided in the air-conditioning system will be described.

The air-conditioning system includes an outside air temperature sensor 25 that measures the temperature of outside air, and a heat medium temperature sensor 40 that measures a heat medium temperature in the heat medium circuit, which is the temperature of the heat medium. Furthermore, the indoor unit 3A, the indoor unit 3B, and the indoor unit 3C include a suction temperature sensor 34*a*, a suction temperature sensor 34*b*, and a suction temperature sensor 34*c*, respectively (hereinafter each referred to as a suction temperature sensor 34 when they do not need to be distinguished from each other), each of which measures a suction temperature corresponding to an indoor space temperature that is the temperature of the indoor space.

The temperature measured by each of the sensors is periodically transmitted from the heat source unit 2 to the air-conditioning management apparatus 50 as operation status information. It should be noted that the indoor unit 3 periodically transmits the suction temperature measured by the suction temperature sensor 34 to the heat source unit 2 via the communication line 5B. The heat source unit 2 transmits all the suction temperature that is transmitted from the indoor unit 3, the heat medium temperature measured by the heat medium temperature sensor 40, and the outside air temperature measured by the outside air temperature sensor 25, as the operation state information, to the air-conditioning management apparatus 50 via the communication line 5A.

Next, the air-conditioning management apparatus 50 will be described.

Figure 3:
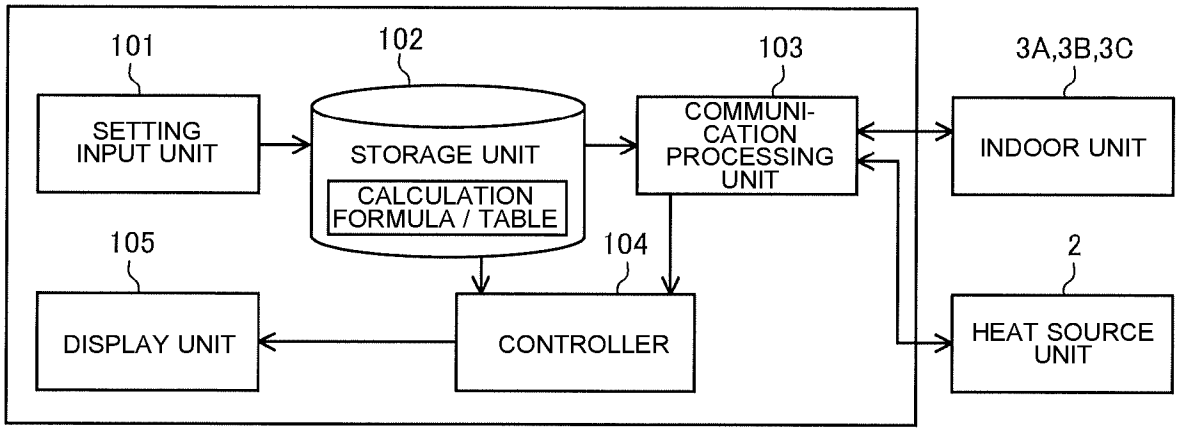
FIG. 3 is a diagram illustrating an internal configuration of the air-conditioning management apparatus according to Embodiment 1 of the present disclosure.

FIG. 3 is a diagram illustrating an internal configuration of the air-conditioning management apparatus according to Embodiment 1 of the present disclosure.

The air-conditioning management apparatus 50 includes a setting input unit 101, a storage unit 102, a communication processing unit 103, a controller 104, and a display unit 105. The setting input unit 101 is, for example, a touch panel. Using the setting input unit 101, a schedule that is used in a schedule control, which will be described below, or other information, is input. The storage unit 102 is, for example, a nonvolatile memory or other memories, and stores the schedule set using the setting input unit 101. In addition, the storage unit 102 stores various types of data for use in control by the controller 104, programs, and other information. The storage unit 102 further stores the operation status information obtained from the heat source unit 2.

The communication processing unit 103 transmits, for example, a control command determined by the controller 104, which will be described below, to the heat source unit 2 and the indoor unit 3. In addition, the communication processing unit 103 receives the operation status information transmitted from the heat source unit 2. The display unit 105 is a display, for example, and displays the contents of setting by the setting input unit 101.

The controller 104 causes either the heating operation or the cooling operation to be performed, by switching the four-way valve 22. In addition, the controller 104 performs the schedule control based on the operation status information obtained from the heat source unit 2 and the schedule stored in the storage unit 102. The schedule control will be described later. In the schedule control, the controller 104 performs a preheating control to preheat the heat medium before the heating operation is started, and the precooling control to precool the heat medium before the cooling operation is started. The controller 104 is a microcomputer, a digital signal processor (DSP), or other devices.

Next, operations by the air-conditioning apparatus will be described.

(Heating Operation)

In the heating operation, the state of the four-way valve 22 is switched to a state indicated by dotted lines in FIG. 2. High-temperature, high-pressure gas refrigerant obtained by compression by the compressor 21 of the heat source unit 2 passes through the four-way valve 22, and then flows out of the heat source unit 2 and flows into the refrigerant-heat-medium heat exchanger 4. The refrigerant that has flowed into the refrigerant-heat-medium heat exchanger 4 exchanges heat with the heat medium from the heat medium circuit 30, that is, transfers heat to the heat medium, and condenses and liquefies to change into high-pressure fluid refrigerant. The fluid refrigerant is reduced in pressure at the expansion valve 24, and then flows into the heat-source-side heat exchanger 23. The refrigerant that has flowed into the heat-source-side heat exchanger 23 exchanges heat with air, evaporates and gasifies, passes through the four-way valve 22, and returns to the compressor 21.

On the other hand, in the heat medium circuit 30, the heat medium is supplied to the refrigerant-heat-medium heat exchanger 4 by the pump 10, exchanges heat with the refrigerant from the refrigerant circuit 20, and is heated. The heat medium is then branched into heat mediums, which flow into the respective indoor units 3. The heat mediums pass through the flow control valves 32 of the respective indoor units 3, and flow into the indoor heat exchangers 31 of the respective indoor units 3. The heat mediums that have flowed into the indoor heat exchangers 31 exchange heat with the indoor air to heat the indoor space. The heat mediums that have been subjected to the heat exchange at the indoor heat exchangers 31 flow out of the respective indoor units 3, and combine into a single heat medium. The heat medium is then sucked into the pump 10.

(Cooling Operation)

In the cooling operation, the state of the four-way valve 22 is switched to a state indicated by solid lines in FIG. 2. The high-temperature, high-pressure gas refrigerant obtained by compression by the compressor 21 of the heat source unit 2 passes through the four-way valve 22, and flows into the heat-source-side heat exchanger 23. The refrigerant that has flowed into the heat-source-side heat exchanger 23 exchanges heat with air, and condenses and liquefies. The liquefied refrigerant is reduced in pressure at the expansion valve 24, and flows into the refrigerant-heat-medium heat exchanger 4. The refrigerant that has flowed into the refrigerant-heat-medium heat exchanger 4 exchanges heat with the heat medium from the heat medium circuit 30, that is, absorbs heat from the heat medium to evaporate and gasify. The refrigerant that has evaporated and gasified re-flows into the heat source unit 2, passes through the four-way valve 22, and returns to the compressor 21.

On the other hand, in the heat medium circuit 30, the heat medium is supplied to the refrigerant-heat-medium heat exchanger 4 by the pump 10, exchanges heat with the refrigerant from the refrigerant circuit 20, and is cooled. The heat medium is then branched into heat mediums. The heat mediums flows into the indoor heat exchangers 31 of the respective indoor units 3. The heat mediums that have flowed into the indoor heat exchangers 31 exchange heat with the indoor air to cool the indoor space. The heat mediums that have been subjected to the heat exchange at the indoor heat exchangers 31 flow out of the respective indoor units 3, and combine into a single heat medium. The heat medium is then sucked into the pump 10.

Next, the outline of the schedule control in the air-conditioning management apparatus 50 will be described. In the following, the schedule control is described by referring to by way of example the preheating control.

In the schedule control, the operation of the air-conditioning apparatus 1 is started before a set time that is set in advance, and an optimal start-up control that causes the indoor space temperature to reach the set temperature is performed until the set time. The set time and the set temperature are stored as the schedule in advance in the storage unit 102.

It should be noted that Embodiment 1 is featured in that the heat medium temperature is raised to a target heat medium temperature before start time of the optimal start-up control. That is, in the schedule control, the preheating control to raise the heat medium temperature to the target heat medium temperature is performed, and the optimal start-up control is then performed. In such a manner, the heat medium temperature is raised to the target heat medium temperature before the optimal start-up control is performed. It is therefore possible to prevent the heat medium temperature at the start time of the optimal start-up control from varying from one start time to another. Then, in the optimal start-up control that is performed after the preheating control, it is possible to stably raise the indoor space temperature to the set temperature by the set time. It should be noted that the target heat medium temperature is set in advance using the setting input unit 101.

A time period in which the schedule control is performed (which will hereinafter be referred to as a schedule control period) is set in advance, and start time of the schedule control is determined based on the set time and the schedule control period. That is, the start time of the schedule control is time that is earlier than the set time by the schedule control period. If the set time is, for example, 8 o'clock, and the schedule control period is, for example, two hours, the schedule control is started at 6 o'clock. Therefore, first, the preheating control is started at 6 o'clock, and the optimal start-up control is then performed in a time period up to 8 o'clock. It should be noted that a user can set the schedule control period, using the setting input unit 101, to an arbitrary time period.

Furthermore, in Embodiment 1, time required to perform the preheating control is calculated in consideration of current environment conditions, and the preheating control is performed for the calculated time, to thereby avoid wasteful power consumption. The time required for the preheating control is calculated using a previously created calculation formula or table. To be more specific, the above required time is calculated by plugging as current environment conditions, the heat medium temperature, the flow rate of the heat medium, the target heat medium temperature, and the outside air temperature to the calculation formula. This calculation formula or table can be calculated from a history of data on the operation status that is obtained by performing a test operation, an actual operation, or both of the test operation and the actual operation, and is previously stored in the storage unit 102.

Then, after the required time elapses from the time at which the schedule control period starts, the optimal start-up control is performed in a remaining time period up to the set time. That is, the flow control valve 32 of the indoor unit 3 is controlled such that the indoor space temperature is raised to the set temperature in the remaining time period. The concrete contents of the optimal start-up control are not limited in the descriptions of the embodiments of the present disclosure, and the optimal start-up control of an existing technique can be adopted.

(Operation During Heating)

Next, the schedule control in the heating operation of the air-conditioning management apparatus 50 will be described with reference to FIG. 4. It should be noted that in the following, it is assumed that all the indoor units 3A to 3C are operated on the same schedule.

Figure 4:
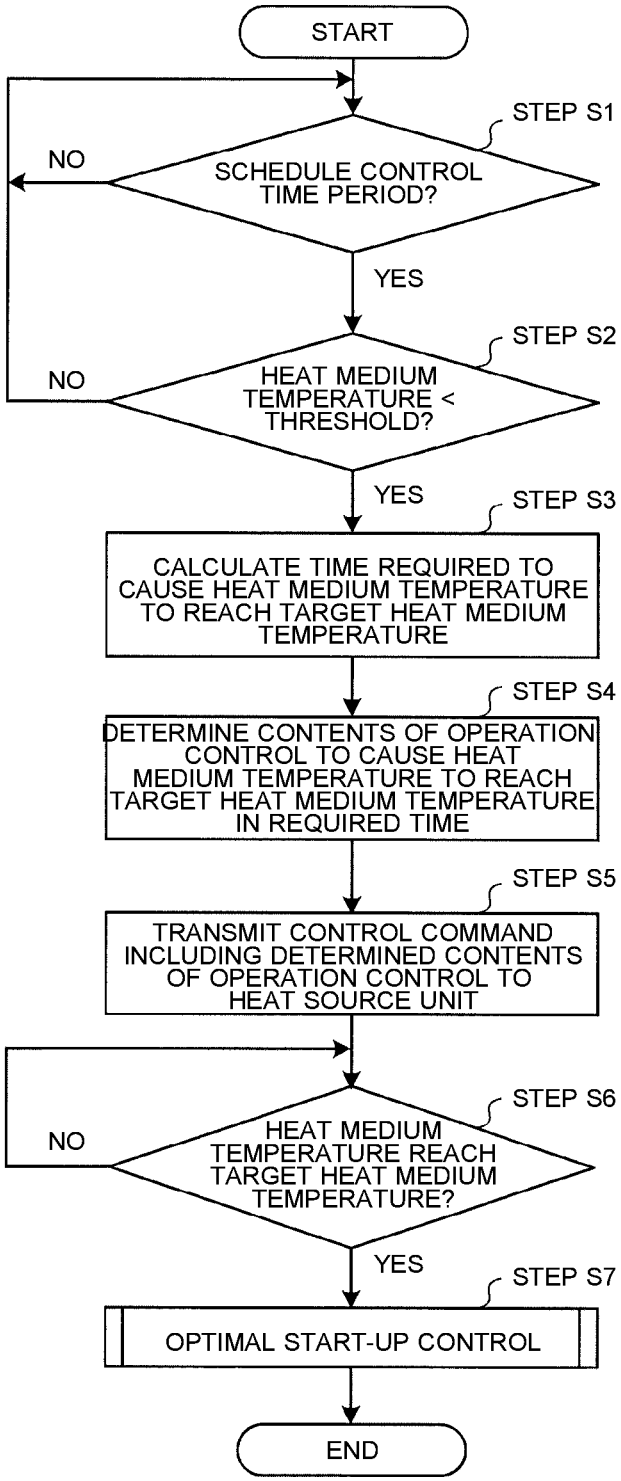
FIG. 4 is a flowchart of a schedule control in a heating operation of the air-conditioning management apparatus according to Embodiment 1 of the present disclosure.

FIG. 4 is a flowchart of the schedule control in the heating operation of the air-conditioning management apparatus according to Embodiment 1 of the present disclosure.

The controller 104 of the air-conditioning management apparatus 50 determines whether or not the start of the schedule control period is reached or not (step S1). To be more specific, the controller 104 determines whether or not the current time is the start time of the schedule control, which is found from the set time and the schedule control period.

When the controller 104 determines that the current time is the start time of the schedule control and the start of the schedule control period is reached, the controller 104 determines whether or not the current heat medium temperature included in the operation status information received from the heat source unit 2 is less than a threshold set in advance (step S2). It should be noted that regarding the preheating control, the user can set the threshold to an arbitrary numeric value that corresponds to a temperature lower than the target heat medium temperature.

When determining that the heat medium temperature is less than the threshold, the controller 104 calculates time required to cause the heat medium temperature to reach the target heat medium temperature, using the calculation formula and the operation status information (step S3). In this example, it is assumed that the schedule control period is two hours, and the required time is an hour and a half. In this case, the controller 104 determines contents of an operation control of the heat source unit 2 that is a control to cause the heat medium temperature to reach the target heat medium temperature in an hour and a half (step S4). As the operation control to be determined, an operating frequency of the compressor 21, etc., are determined in consideration of a temperature difference between the heat medium temperature and the target heat medium temperature, the required time, and other information.

Then, the controller 104 transmits a control command including the determined contents of the operation control to the heat source unit 2 (step S5). In the heat source unit 2, an operation to raise the temperature of the heat medium is performed, for example, by increasing the operating frequency of the compressor 21 in response to the control command. Then, when the heat medium temperature reaches the target heat medium temperature (step S6), the controller 104 starts the optimal start-up control (step S7). In this case, all the indoor units 3 are operated according to the same schedule. Therefore, the control command transmitted from the air-conditioning management apparatus 50 to the heat source unit 2 includes commands to adjust the opening degrees of the flow control valves 32 of all the indoor units 3. The commands are transmitted from the heat source unit 2 to the respective indoor units 3 at the same timing. In each of all the indoor units 3, in response to the command, the opening degree of the flow control valve 32 is adjusted such that the suction temperature measured by the suction temperature sensor 34 (that is equivalent to the indoor space temperature) reaches the set temperature. It should be noted that in Embodiment 1, the air-conditioning management apparatus 50 is connected to the heat source unit 2 by the communication line 5A, but is not connected to the indoor units 3. Therefore, the control command to be transmitted to the heat source unit 2 includes commands to the indoor units 3. However, in the case where the air-conditioning management apparatus 50 is connected to the indoor units 3 by communication lines, it suffices that the commands may be directly transmitted from the air-conditioning management apparatus 50 to the indoor units 3.

By the above processes, the heat medium temperature can be raised to the target heat medium temperature before the optimal start-up control is started. It should be noted that in step S6, it is determined whether or not the heat medium temperature reaches the target heat medium temperature, but it may also be determined whether or not the heat medium temperature falls within a target range including the target heat medium temperature. It suffices that this target range is set to, for example, a range of 1 degree C. above the target heat medium temperature to 1 degree C. below the target heat medium temperature.

Next, the schedule control in the cooling operation in the air-conditioning management apparatus 50 will be briefly described. The schedule control in the cooling operation is substantially similar to that in the heating operation. In the schedule control in the cooling operation, in the schedule control period, the optimal start-up control is performed after the precooling control to cause the heat medium temperature to reach the target heat medium temperature is performed.

Figure 5:
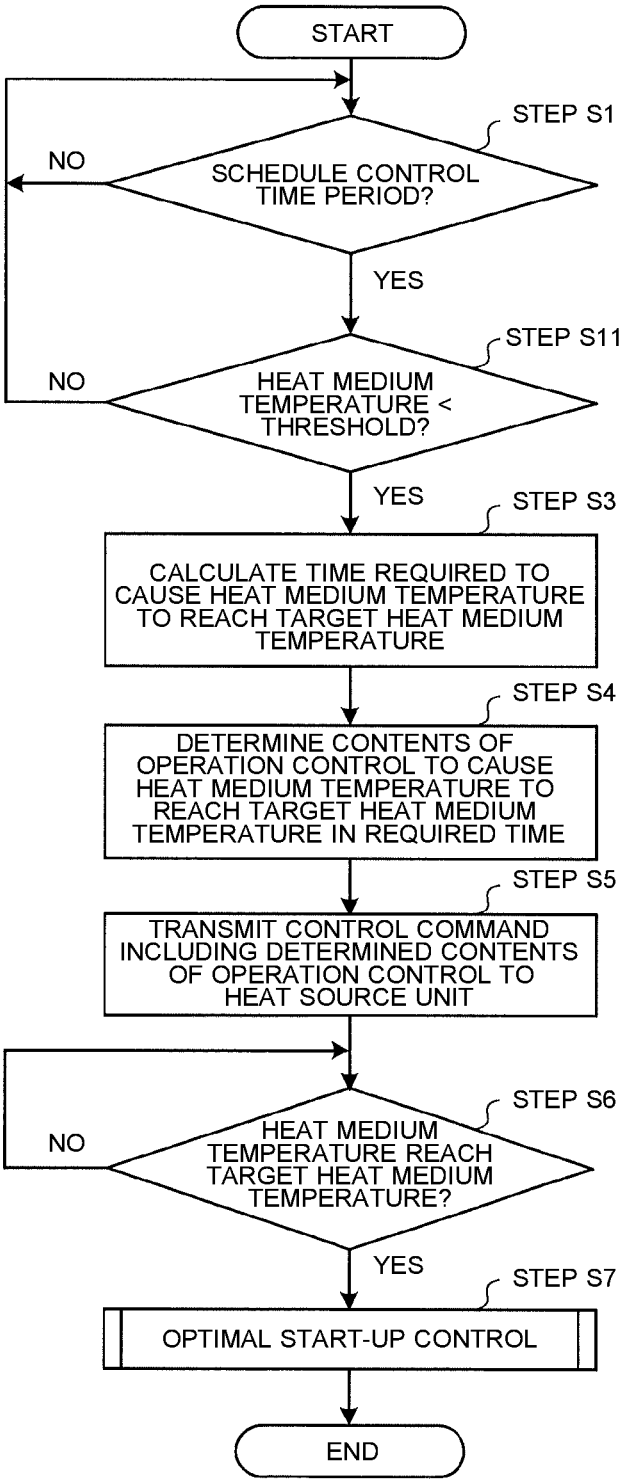
FIG. 5 is a flowchart of a schedule control in a cooling operation of the air-conditioning management apparatus according to Embodiment 1 of the present disclosure.

FIG. 5 is a flowchart of the schedule control in the cooling operation of the air-conditioning management apparatus according to Embodiment 1 of the present disclosure.

In the cooling operation, the threshold is set to a temperature higher than the target heat medium temperature. The schedule control in the cooling operation is different from that in the heating operation indicated in the flowchart of FIG. 4 only in the determination in step S2. To be more specific, in the schedule operation in the cooling operation, the controller 104 determines whether the heat medium temperature measured by the heat medium temperature sensor 40 is higher than the threshold set in advance or not (step S11). Then, when the heat medium temperature is higher than the threshold, processes from the process of step S3 onward, which are the same as those in the heating operation, are carried out.

As described above, in the air-conditioning management apparatus 50 according to Embodiment 1, the preheating control or the precooling control is performed, whereby the heat medium temperature falls within the target range before the optimal start-up control is performed. Therefore, it is possible to prevent the heat medium temperature at the start time of the optimal start-up control from varying from one start time to another. It is therefore possible to stably cause the indoor space temperature to reach the set temperature at desired time for the user.

Furthermore, the time required to cause the heat medium temperature to reach the target heat medium temperature is calculated using the calculation formula and the heat medium temperature, the flow rate of the heat medium, the target heat medium temperature, and the outside air temperature, and the preheating control or the precooling control is performed in the calculated required time. Thus, it is possible to avoid waste of the power consumption that would be caused by performing the preheating control or the precooling control for an unnecessarily long period of time. In addition, if the preheating control or the precooling control is performed for an unnecessarily long period of time, it is also necessary to consider heat that is transferred from the heat medium, as a result of which power is wastefully consumed. Therefore, by performing the preheating control or the precooling control in the required time calculated in consideration of the current environment conditions, it is possible to efficiently cause the heat medium temperature to reach the target heat medium temperature.

Embodiment 2

In Embodiment 1 described above, the indoor units 3 are installed in the same indoor space, and the schedules set for the indoor units 3 are the same as each other. By contrast, in Embodiment 2, the indoor units 3 are installed in different spaces, and the schedules set for the indoor units 3 are different from each other. For example, it is assumed that schedules are set such that the indoor unit 3A starts the heating operation at 8 o'clock, the indoor unit 3B starts the heating operation at 9 o'clock, and the indoor unit 3C starts the heating operation at 10 o'clock, and the schedule control period is two hours. Also, it is assumed that this schedule is also applied to subsequent embodiments as described below. It should be noted that "the indoor unit 3A starts the heating operation at 8 o'clock" means that the suction temperature of the indoor unit 3A reaches the set temperature at 8 o'clock. In addition, the set temperatures in all the indoor units 3 are the same as each other.

In the above case, "8 o'clock" corresponding to the earliest set time is applied as set time at which the start time of the preheating control is determined. That is, based on "8 o'clock" corresponding to the set time and "two hours" corresponding to the schedule control period, 6 o'clock is determined as the start time of the preheating control. Then, the optimal start-up control is performed such that the suction temperatures of the suction temperature sensors 34 of all the indoor units 3 reach the set temperature at 8 o'clock. In the optimal start-up control, commands to adjust the opening degrees of the flow control valves 32 are transmitted from the heat source unit 2 to all the indoor units 3, as in Embodiment 1.

Embodiment 3

Embodiment 3 relates to another control in the case where different schedules are set for the respective indoor units 3 as in Embodiment 2.

It is assumed that schedules are set to be the same as those in Embodiment 2. In Embodiment 3, first, in order to satisfy the schedule of the indoor unit 3A whose set time is the earliest, the preheating operation is started at 6 o'clock to enable the indoor unit 3A to start the heating operation at 8 o'clock. Then, in the optimal start-up control in step S7, first, only the indoor unit 3A is operated. To be more specific, only the flow control valve 32*a* is opened and the opening degree of the flow control valve 32*a* is adjusted, and the flow control valve 32*b* and the flow control valve 32*c* are kept closed. Thus, preheating is performed at the minimum required flow rate of the heat medium.

Since the heat medium temperature reaches the target heat medium temperature because of execution of the preheating control, the indoor unit 3B, which will start the heating operation at 9 o'clock, and the indoor unit 3C, which will start the heating operation at 10 o'clock, are subjected to the optimal start-up control according to set times for the indoor unit 3B and the indoor unit 3C. In the optimal start-up control, a control command including commands that are each given to an associated one of the indoor unit 3B and the indoor unit 3C to adjust the opening degree of an associated one of the flow control valve 32*b* and the flow control valve 32*c* based on the set time for the associated one of the indoor unit 3B and the indoor unit 3C is sent from the controller 104 to the heat source unit 2.

In Embodiment 3, it suffices that the temperature of the heat medium at the flow rate of the heat medium that circulates in the indoor heat exchanger 31 of the indoor unit 3A that starts at the earliest time is caused to reach the target heat medium temperature. Thus, in Embodiment 3, it is possible to reduce the power consumption, as compared with Embodiment 2 in which the temperatures of the heat mediums at the flow rates of the heat mediums that circulates also in the indoor unit 3C and the indoor unit 3C in addition to the indoor unit 3A that starts at the earliest time need to be caused to reach the target heat medium temperature.

Embodiment 4

Embodiment 4 relates to the control of the flow control valves 32 in the indoor unit 3B and the indoor unit 3C that start the heating operation second and third in Embodiment 3.

When the flow control valve 32*b* and the flow control valve 32*c* that are in closed state are opened, especially, for example, when the flow control valve 32*b* and the flow control valve 32*c* are fully opened, the heat mediums stored in the indoor heat exchangers or other parts of the indoor unit 3B and the indoor unit 3C, that is, the heat mediums that are not preheated, abruptly flow into the heat medium circuit 30. Thus, the suction temperature of the indoor unit 3A that is in operation abruptly drops. This affects the operation of the indoor unit 3A. This point will be described with reference to FIG. 6.

Figure 6:
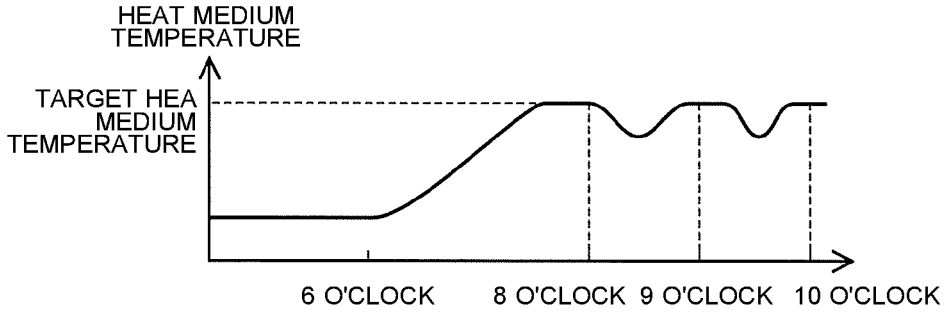
FIG. 6 is a diagram indicating a change of a heat medium temperature.

FIG. 6 is a graph indicating a change of the heat medium temperature. FIG. 6 indicates the change of the heat medium temperature in the case where the flow control valve 32*b* and the flow control valve 32*c* are both fully opened.

In this example, the preheating control is started at 6 o'clock that is two hours before 8 o'clock that is set time. Then, after the preheating control is started, the heat medium temperature reaches the target heat medium temperature before 8 o'clock. Then, because the indoor unit 3B starts the heating operation at 9 o'clock, the flow control valve 32*b* of the indoor unit 3B is fully opened before 9 o'clock, and the flow control valve 32*c* of the indoor unit 3C is fully opened before 10 o'clock. In such a manner, when the flow control valve 32*b* and the flow control valve 32*c* are both fully opened, the heat medium temperature temporarily drops as indicated in FIG. 6. When the heat medium temperature drops, the temperature of air that blows out from the indoor unit 3A into the indoor space drops, and the indoor space temperature may drop to fall below the set temperature.

In view of the above, in Embodiment 4, when the flow control valve 32*b* and the flow control valve 32*c* that are in closed state are both opened, the opening degrees of the flow control valve 32*b* and the flow control valve 32*c* are gradually increased. To be more specific, the flow control valve 32*b* and the flow control valve 32*c* are gradually opened such that the opening degrees of the flow control valve 32*b* and the flow control valve 32*c* are increased by a previously set value each time the opening degrees are changed. This control can reduce lowering of the heat medium temperature.

It should be noted that in the case where the heat medium temperature varies even when the opening degree of the flow control valves 32 is gradually increased, the refrigerant circuit 20 is controlled to, for example, gradually increase the operating frequency of the compressor 21, thereby reducing the variation of the heat medium temperature.

Embodiment 5

In Embodiment 5, before the flow control valve 32*b* and the flow control valve 32*c* of the indoor unit 3B and the indoor unit 3C that start the heating operation second and third in Embodiment 3 are opened, the heat medium is preheated such that the heat medium temperature exceeds the target heat medium temperature.

Figure 7:
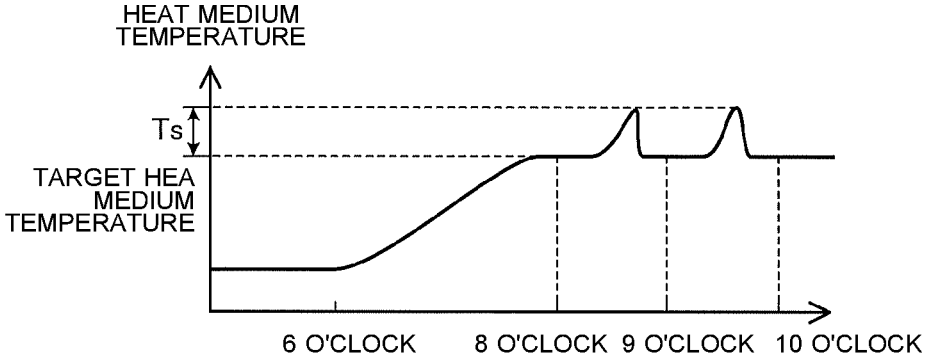
FIG. 7 is a diagram indicating a change of a heat medium temperature in an air-conditioning management apparatus according to Embodiment 5 of the present disclosure.

FIG. 7 is a graph indicating a change of the heat medium temperature in the air-conditioning management apparatus according to Embodiment 5 of the present disclosure.

In this example, the preheating control is started at 6 o'clock that is two hours before 8 o'clock that is set time. Then, after the preheating control is started, the heat medium temperature reaches the target heat medium temperature before 8 o'clock. Then, since the indoor unit 3B starts the heating operation at 9 o'clock, the heat medium is preheated before 9 o'clock such that the heat medium temperature reaches a temperature that is higher than the target heat medium temperature by a previously set temperature Ts. In addition, since the indoor unit 3C starts the heating operation at 10 o'clock, the heat medium is preheated before 10 o'clock such that the heat medium temperature reaches a temperature that is higher than the target heat medium temperature by the previously set temperature Ts.

In such a manner, in Embodiment 5, before the flow control valve 32*b* and the flow control valve 32*c* of the indoor unit 3B and the indoor unit 3C that start the heating operation second and third are opened, the heat medium is excessively preheated. Thus, even when the heat medium temperature changes after the flow control valve 32*b* and the flow control valve 32*c* are opened, the heat medium temperature does not fall below the target heat medium temperature, that is, the heat medium temperature is still higher than or equal to the target heat medium temperature. It should be noted that in the case where the heat medium is being excessively preheated, the rotation speed of the fan 33*a* of the indoor unit 3A is reduced to prevent the indoor space temperature from differing from the set temperature.

It should be noted that Embodiments 1 to 5 are described above by referring to way of example the case where the number of heat medium circuits 30 is one; however, the heat medium circuit 30 may also include a plurality of heat medium circuits 30. For example, the configurations of the embodiments may be set as follows: heat medium circuits 30 are provided for respective floors of a building, refrigerant circuits 20 and refrigerant-heat-medium heat exchangers 4 are provided such that the number of the refrigerant circuits 20 and that of the refrigerant-heat-medium heat exchangers 4 are equal to that of the heat medium circuits 30, and the heat medium circuits 30 are connected to the refrigerant circuits 20 by the refrigerant-heat-medium heat exchanger 4 as illustrated in FIG. 1.

Furthermore, for example, each of the indoor units 3 in the heat medium circuit 30 on the first floor is also connected to the heat medium circuit 30 on the second floor by using a coupling pipe and a three-way valve.

The above configurations are effective to stabilize the heat medium temperature when the following operation is performed. To be more specific, the above configurations are effective in the case where in a situation in which all the indoor units 3 in the heat medium circuit 30 on the first floor are operated, and in the heat medium circuit 30 on the second floor, the indoor unit 3A is in operation, and the indoor unit 3B and the indoor unit 3C are in stopped state, the indoor unit 3B on the second floor is suddenly operated with no schedule. In this case, the indoor unit 3B on the second floor that has no schedule is connected to the heat medium circuit 30 on the first floor via the coupling pipe and the three-way valve. Because of this configuration, the variation of the heat medium temperature of the heat medium circuit 30 on the second floor can be reduced, as compared with the case where the heat medium of the heat medium circuit 30 on the second floor is circulated in the indoor unit 3B on the second floor. It should be noted that during the normal operation, that is, in the case where heat mediums are independently circulated in the heat medium circuits 30 on the respective floors, in each heat medium circuit 30, the three-way valve may be controlled such that the heat medium does not flow towards the coupling pipe.

REFERENCE SIGNS LIST

1 air-conditioning apparatus,
2 heat source unit,
3 indoor unit,
3A indoor unit,
3B indoor unit,
3C indoor unit,
4 refrigerant-heat-medium heat exchanger,
5A communication line,
5B communication line,
6 refrigerant pipe,
7 heat medium pipe,
8 indoor space,
10 pump,
14 outdoor heat exchanger,
20 refrigerant circuit,
21 compressor,
22 four-way valve,
23 heat-source-side heat exchanger,
24 expansion valve,
25 outside air temperature sensor,
30 heat medium circuit,
31 indoor heat exchanger,
31*a* indoor heat exchanger,
32 flow control valve,
32*a* flow control valve,
32*b* flow control valve,
32*c* flow control valve,
33 fan,
33*a* fan,
34 suction temperature sensor,
34*a* suction temperature sensor,
34*b* suction temperature sensor,
34*c* suction temperature sensor,
40 heat medium temperature sensor,
50 air-conditioning management apparatus,
101 setting input unit,
102 storage unit,
103 communication processing unit,
104 controller,
105 display unit

The invention claimed is:

1. An air-conditioning management apparatus that controls an air-conditioning apparatus that comprises:

a heat source unit;

one or more indoor units; and a refrigerant-heat-medium heat exchanger configured to cause heat exchange to be performed between refrigerant that flows in the heat source unit and a heat medium that flows in the one or more indoor units to heat or cool the heat medium and heat or cool an indoor space, the air-conditioning management apparatus comprising:

a storage unit configured to store a schedule including a set time and a set temperature;

a communication processing unit configured to communicate with the air-conditioning apparatus and receive operation status information including a heat medium temperature that is a temperature of the heat medium; and a controller configured to perform a schedule control to control the air-conditioning apparatus according to the schedule, wherein the schedule control includes an optimal start-up control to control the air-conditioning apparatus such that an indoor space temperature that is a temperature of the indoor space reaches the set temperature at the set time, by starting an operation of the air-conditioning apparatus before the set time, the controller performs a preheating control or a precooling control to control the heat source unit such that before the optimal start-up control is started, the heat medium temperature included in the operation status information obtained from the air-conditioning apparatus falls within a target range including a previously set target heat medium temperature, the storage unit stores a calculation formula or a table prepared to calculate a required time required for the preheating control or the precooling control based on the heat medium temperature, a heat medium flow rate that is a flow rate of the heat medium, the target heat medium temperature, and an outside air temperature, the operation status information includes the heat medium flow rate and the outside air temperature, and the controller performs the preheating control or the precooling control for the required time calculated based on the operation status information received by the communication processing unit and the calculation formula or the table stored in the storage unit.

2. The air-conditioning management apparatus of claim 1, wherein each of the one or more indoor units includes a flow control valve configured to adjust a flow rate of the heat medium that flows into the indoor unit itself, the flow control valve being adjusted in opening degree to adjust the indoor space temperature, and the controller transmits a command to adjust the opening degree of the flow control valve to the one or more indoor units at the same timing, when the optimal start-up control is performed.

3. The air-conditioning management apparatus of claim 1, wherein the controller starts the preheating control or the precooling control at a time that is earlier than the set time by a previously set schedule control period, and when the air-conditioning apparatus comprises a plurality of indoor units, the storage unit stores as schedules, a schedule for each indoor unit, including as set times, a set time for each indoor unit, and a set temperature; and when the set times in the schedules that are made out for the plurality of indoor units differ from each other, the controller starts the schedule control by using an earliest set time as a set time at which start time of the preheating control or the precooling control is determined, and individually performs the optimal start-up control of the plurality of indoor units according to the set times for the one or more indoor units.

4. An air-conditioning system comprising:

the air-conditioning management apparatus of claim 1; and the air-conditioning apparatus.

5. An air-conditioning management apparatus that controls an air-conditioning apparatus that comprises:

a heat source unit;

a plurality of indoor units; and a refrigerant-heat-medium heat exchanger configured to cause heat exchange to be performed between refrigerant that flows in the heat source unit and a heat medium that flows in the plurality of indoor units to heat or cool the heat medium and heat or cool an indoor space of each of the plurality of indoor units, the air-conditioning management apparatus comprising:

a storage unit configured to store as schedules, a schedule for each of the plurality of indoor units, including as set times, a set time for each of the plurality of indoor units, and a set temperature;

a communication processing unit configured to communicate with the air-conditioning apparatus and receive operation status information including a heat medium temperature that is a temperature of the heat medium; and a controller configured to perform a schedule control to control the air-conditioning apparatus according to the schedules, wherein the schedule control includes an optimal start-up control to control the air-conditioning apparatus such that a temperature of each indoor space of the plurality of indoor units reaches the set temperature at one of the set times, by starting an operation of the air-conditioning apparatus before the one of the set times, the controller performs a preheating control or a precooling control to control the heat source unit such that before the optimal start-up control is started, the heat medium temperature included in the operation status information obtained from the air-conditioning apparatus falls within a target range including a previously set target heat medium temperature, when the set times in the schedules that are made out for the plurality of indoor units are different from each other, the optimal start-up control is performed such that a suction temperature of each of the plurality of indoor units reaches the set temperature at the one of the set times, which is an earliest one of the set times.

6. The air-conditioning management apparatus of claim 5, wherein the storage unit stores a calculation formula or a table prepared to calculate a required time required for the preheating control or the precooling control based on the heat medium temperature, a heat medium flow rate that is a flow rate of the heat medium, the target heat medium temperature, and an outside air temperature, the operation status information includes the heat medium flow rate and the outside air temperature, and the controller performs the preheating control or the precooling control for the required time calculated based on the operation status information received by the communication processing unit and the calculation formula or the table stored in the storage unit.

7. The air-conditioning management apparatus of claim 5, wherein the controller starts the preheating control or the precooling control at a time that is earlier than the one of the set times, which is the earliest one of the set times, by a previously set schedule control period, and when the set times in the schedules made out for the plurality of indoor units differ from each other, the controller starts the schedule control by using the one of the set times, which is the earliest one of the set times, in determining a start time of the preheating control or the precooling control.

8. An air-conditioning management apparatus that controls an air-conditioning apparatus that comprises:

a heat source unit;

a plurality of indoor units; and a refrigerant-heat-medium heat exchanger configured to cause heat exchange to be performed between refrigerant that flows in the heat source unit and a heat medium that flows in the plurality of indoor units to heat or cool the heat medium and heat or cool an indoor space of each of the plurality of indoor units, the air-conditioning management apparatus comprising:

a storage unit configured to store as schedules, a schedule for each indoor unit of the plurality of indoor units, including as set times, a set time for each indoor unit, and a set temperature;

a communication processing unit configured to communicate with the air-conditioning apparatus and receive operation status information including a heat medium temperature that is a temperature of the heat medium; and a controller configured to perform a schedule control to control the air-conditioning apparatus according to the schedule, wherein the schedule control includes an optimal start-up control to control the air-conditioning apparatus such that a temperature of a first indoor space of a first indoor unit reaches the set temperature at a first set time of the set times, by starting an operation of the air-conditioning apparatus before the first set time, the controller performs a preheating control or a precooling control to control the heat source unit such that before the optimal start-up control is started, the heat medium temperature included in the operation status information obtained from the air-conditioning apparatus falls within a target range including a previously set target heat medium temperature, each of the plurality of indoor units includes a flow control valve configured to adjust a flow rate of the heat medium that flows into the indoor unit itself, each flow control valve being adjusted in opening degree to adjust a temperature of a respective indoor space of a respective indoor unit, the controller transmits a command to adjust the opening degree of the flow control valve of the first indoor space of the first indoor unit, when the optimal start-up control is performed, and the controller controls the heat source unit to preheat or precool the heat medium such that the heat medium temperature of the heat medium exceeds or falls below the target heat medium temperature prior to opening the flow control valve of any additional indoor unit having a set time that is subsequent to the first set time.

9. The air-conditioning management apparatus of claim 8, wherein in the optimal start-up control, when the flow control valve of the first indoor unit is opened from a closed state, the opening degree of the flow control valve of the first indoor unit is gradually increased.

* * * * *